US008040288B2

(12) United States Patent
Baldauf

(10) Patent No.: US 8,040,288 B2
(45) Date of Patent: Oct. 18, 2011

(54) DIPOLE FOR HEMISPHERICAL COVERAGE ANTENNA

(75) Inventor: John E. Baldauf, Redondo Beach, CA (US)

(73) Assignee: The Boeing Company, Chicago, IL (US)

( * ) Notice: Subject to any disclaimer, the term of this patent is extended or adjusted under 35 U.S.C. 154(b) by 377 days.

(21) Appl. No.: 12/337,579

(22) Filed: Dec. 17, 2008

(65) Prior Publication Data

US 2010/0149062 A1 Jun. 17, 2010

(51) Int. Cl.
*H01Q 21/26* (2006.01)
*H01Q 21/20* (2006.01)

(52) U.S. Cl. ..... 343/797; 343/793; 343/799; 343/780; 343/810

(58) Field of Classification Search ..... None
See application file for complete search history.

(56) References Cited

U.S. PATENT DOCUMENTS

| | | | | |
|---|---|---|---|---|
| 3,740,754 | A * | 6/1973 | Epis | 343/797 |
| 3,896,450 | A * | 7/1975 | Fitzroy et al. | 343/797 |
| 3,919,710 | A * | 11/1975 | Fletcher et al. | 343/770 |
| 3,922,683 | A * | 11/1975 | Kumpebeck | 343/797 |
| 6,271,800 | B1 * | 8/2001 | Nakamura et al. | 343/797 |
| 7,439,927 | B2 * | 10/2008 | Lenart et al. | 343/797 |
| 7,839,351 | B2 * | 11/2010 | Schadler et al. | 343/890 |

* cited by examiner

*Primary Examiner* — Trinh Dinh
(74) *Attorney, Agent, or Firm* — Toler Law Group

(57) ABSTRACT

Systems and methods for providing an antenna enabling hemispherical coverage are disclosed. The system includes a conductive enclosure having an open portion and a closed portion. The system further includes a pair of perpendicularly-disposed dipole antennas. Each antenna of the perpendicularly-disposed dipole antennas includes a pair of conductors extending to a pair of tips disposed outside of the open portion of the conductive enclosure. The system further includes a hybrid coupler having a pair of output terminals coupled to each pair of conductors of each antenna of the perpendicularly-disposed dipole antennas. The hybrid coupler is configured to apply signals of equal magnitude to the each antenna of the perpendicularly-disposed dipole antennas that differ in phase by ninety degrees.

12 Claims, 8 Drawing Sheets

DIPOLE FOR HEMISPHERICAL COVERAGE ANTENNA

FIELD OF THE DISCLOSURE

The present disclosure is generally related to an antenna configured to provide hemispherical signal coverage in a three-dimensional space or semicircular coverage in a two-dimensional range.

BACKGROUND

Existing hemispherical coverage antenna designs, including examples such as quadrafilar helices and conical spiral antennas, present some problems. For example, a quadrafilar helix antenna may provide hemispherical coverage, but may not be sufficiently durable to withstand the acceleration, vibration, and other stresses that attend launch, deployment, and operation of an antenna disposed on a vehicle. Both the quadrafilar helix antenna and a log conical spiral antenna include a nonconductive structural member that provides structural support to the antenna. However, while the nonconductive structural member supports the antenna, the nonconductive structural member—as is the case with any nonconductive components—may absorb charged particles in space. Thus, the nonconductive structural member may accumulate large electrical charges that could result in electro-static discharges (ESDs). ESDs may produce voltage spikes that can damage sensitive electronic devices connected to the antenna, such as telemetry equipment and other devices. Thus, certain currently available antennas that provide hemispherical coverage have deficiencies, such as being structurally fragile and potentially producing damaging ESD discharges.

SUMMARY

Systems and methods for providing an antenna enabling hemispherical, circular polarization coverage are disclosed.

According to a particular illustrative embodiment, a system includes a conductive enclosure. The conductive enclosure has an open portion and a closed portion. The system further includes a pair of perpendicularly-disposed dipole antennas. Each antenna of the pair of perpendicularly-disposed dipole antennas includes a pair of conductors extending to a pair of tips disposed outside of the open portion of the conductive enclosure. The system further includes a hybrid coupler having a pair of output terminals coupled to each pair of conductors of each antenna of the pair perpendicularly-disposed dipole antennas. The hybrid coupler is configured to apply signals of equal amplitude to the pair of perpendicularly disposed dipole antennas that differ in phase by ninety degrees.

According to another particular illustrative embodiment, a system includes a conductive enclosure having an open portion and a closed portion. The system further includes a first dipole antenna having tips disposed outside of the open portion of the conductive enclosure. A positioning of the tips and dimensions of the conductive enclosure are configured in proportion to a selected wavelength to direct a direct signal generated by the first dipole antenna and an indirect signal reflected by the conductive enclosure to provide a hemispherical coverage area.

According to another particular illustrative embodiment, a method includes identifying a selected wavelength at which a pair of perpendicularly-disposed dipole antennas will operate. Each antenna of the pair of perpendicularly-disposed dipole antennas has a same shape and includes conductors ending in tips. The conductors of the pair of perpendicularly-disposed dipole antennas are disposed to extend along a central axis of a conductive enclosure from the closed portion of the conductive enclosure to a first distance beyond the open portion of the conductive enclosure. The tips of the pair of perpendicularly-disposed dipole antennas are disposed to extend from the conductors at an acute angle between the tips and the central axis of the conductive enclosure.

The features, functions, and advantages that have been discussed can be achieved independently in various embodiments or may be combined in yet other embodiments, further details of which can be seen with reference to the following description and drawings.

DETAILED DESCRIPTION

Systems and methods of the present disclosure provide an antenna enabling hemispherical coverage. By selectively shaping and positioning a dipole antenna over an open portion of a selectively-shaped conductive enclosure, a direct signal transmitted by the dipole antenna and a reflected signal reflected by the conductive enclosure provide one-hundred-eighty degree coverage in a plane including the dipole antenna. By coupling a pair of perpendicularly-disposed dipole antennas to a directional coupler circuit configured to apply equal amplitude signals to the pair of perpendicularly disposed dipole antennas that differ in phase by ninety degrees, the signals may be modulated to provide circular polarization over the full hemispherical coverage of a three-dimensional space.

Figure 1:
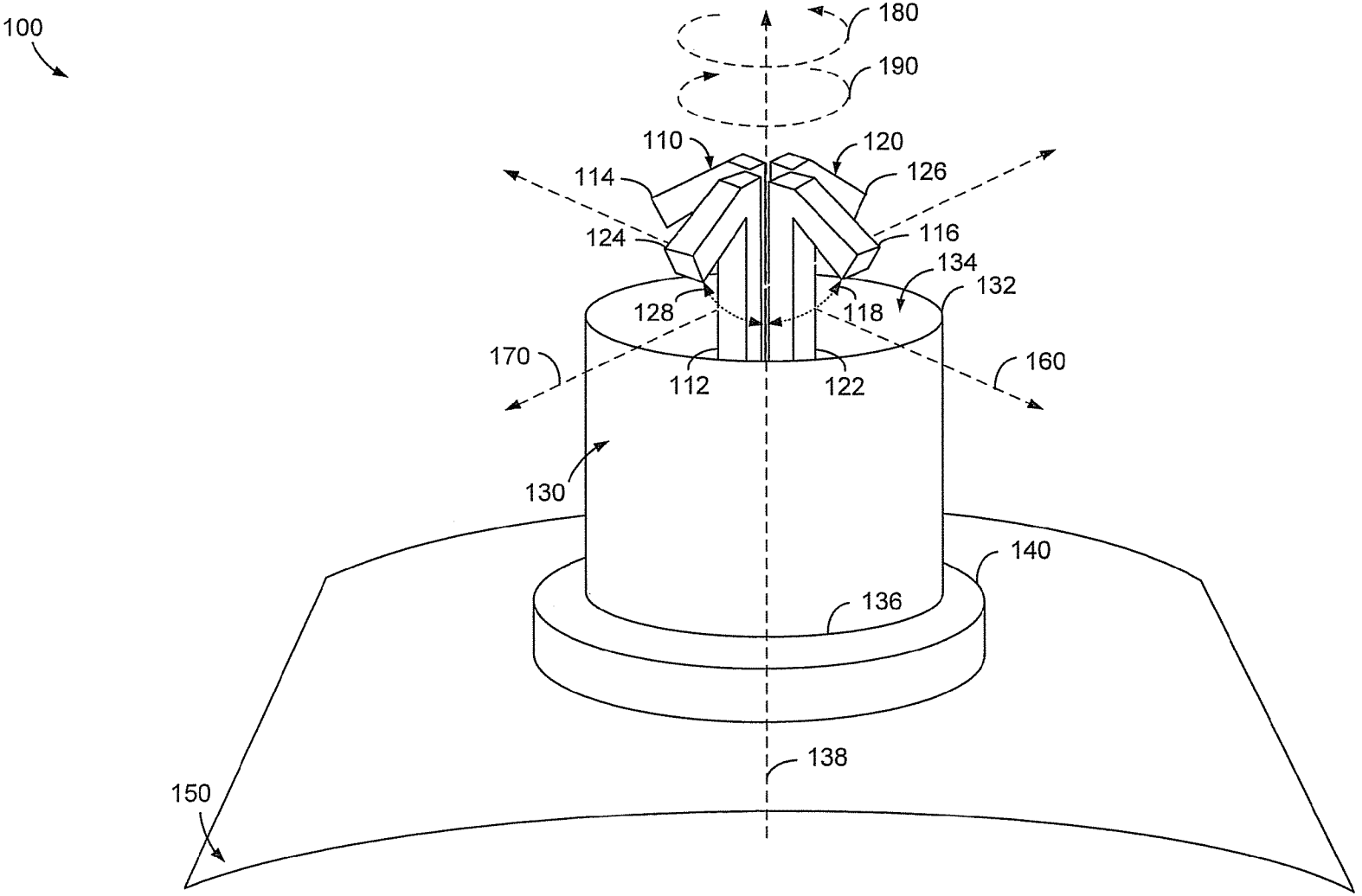
FIG. 1 is a perspective view of an embodiment of an antenna system including a pair of perpendicularly-disposed dipole antennas extending outside an open portion of a conductive enclosure mounted on a vehicle.

FIG. 1 is a perspective view of an antenna system 100 including a pair of perpendicularly-disposed dipole antennas 110 and 120 extending beyond an open portion 132 of a conductive enclosure 130. According to one embodiment, the antenna system 100 includes a base 140 that, in the particular illustrative embodiment, is mounted on a surface 150. As further described below, according to one embodiment, the base 140 defines a compartment (not shown in FIG. 1) that includes directional coupler circuitry (also not shown in FIG.

1) to modulate the phase of signals applied to the pair of perpendicularly-disposed dipole antennas 110 and 120. The shape and relative dimensions of the pair of perpendicularly-disposed dipole antennas 110 and 120 enable hemispherical signal coverage of a three-dimensional space, and the directional coupler circuitry enables circular polarization of a signal transmitted throughout the hemispherical coverage area.

The conductive enclosure 130 may include a cylindrical housing circumscribing a cylindrical cavity 134. The conductive enclosure 130 may be formed from any conductive material, such as aluminum or another metal or other conductive material. Using a conductive material, the charged particles absorbed by antenna system 100 do not accumulate and produce voltage spikes that could damage electronics coupled to the antenna system 100 or other systems due to the conductivity of the antenna body.

According to one embodiment, conductors 112 and 122 of the pair of perpendicularly-disposed dipole antennas 110 and 120 extend through the conductive enclosure 130 from a closed portion 136 of the conductive enclosure 130 adjacent to the base 140 along a central axis 138 of the conductive enclosure 130 beyond the open portion 132 of the conductive enclosure 130. Each of tips 114, 116 and 124, 126 of the pair of perpendicularly-disposed dipole antennas 110 and 120 extend from the respective conductors 112 and 122 at an acute angle 118 and 128 with respect to the central axis 132. The shaping and the dimensions of the pair of perpendicularly-disposed dipole antennas 110 and 120 are described further below with reference to FIG. 4.

The tips 114, 116 of the first dipole antenna 110 extend along a first axis 160 and the 124, 126 of the second dipole antenna 120 extend along a second axis 170 that is perpendicular to the first axis 160. In one embodiment, the open portion 132 of the conductive enclosure 130 lies in the plain defined by the first axis 160 and the second axis 170. Both the first axis 160 and the second axis 170 are perpendicular to the central axis 138 of the conductive enclosure 130. An embodiment of the antenna system 100 enables hemispherical, $2\pi$ steradian coverage of a three dimensional space bounded by the plane described by the first axis 160 and the second axis 170 toward the tips 114, 116 and 124, 126 of the pair of perpendicularly-disposed dipole antennas 110 and 120.

As described further below, depending on how signals are coupled to the pair of perpendicularly-disposed dipole antennas 110 and 120, the antenna system 100 may generate signals having either a right-hand circular polarization 180 or a left-hand circular polarization 190. Application of the signal to a hybrid coupler connected to the pair of perpendicularly-disposed dipole antennas 110 and 120 controls the circular polarization of the signals, as described further below.

As previously described, an illustrative embodiment of the antenna system 100 enables hemispherical coverage of a three-dimensional space. However, if dipole antennas included in the pair of perpendicularly-disposed dipole antennas 110 and 120 are not coupled to a directional coupler, each antenna of the pair of perpendicularly-disposed dipole antennas 110 and 120 may be used independently to provide linearly polarized signals over a wide coverage area.

Figure 2A:
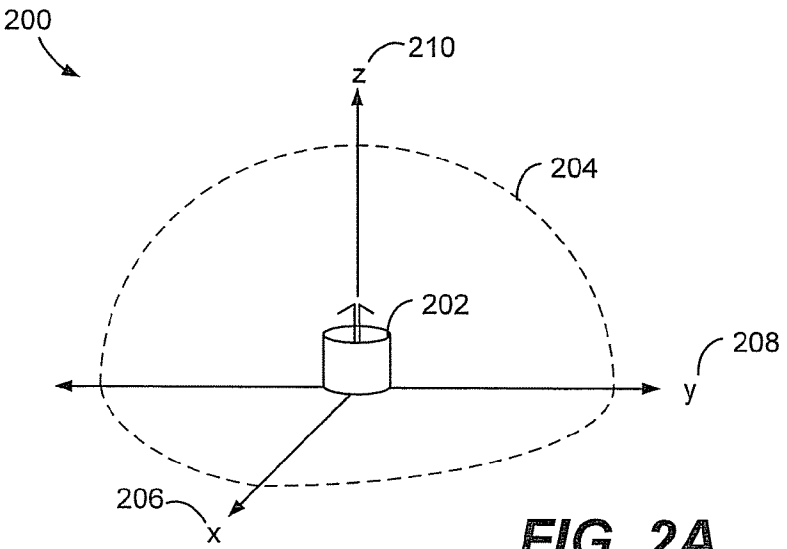
FIGS. 2A-2C are graphical views of an embodiment of a hemispherical coverage of the antenna system of FIG. 1.
Figure 2B:
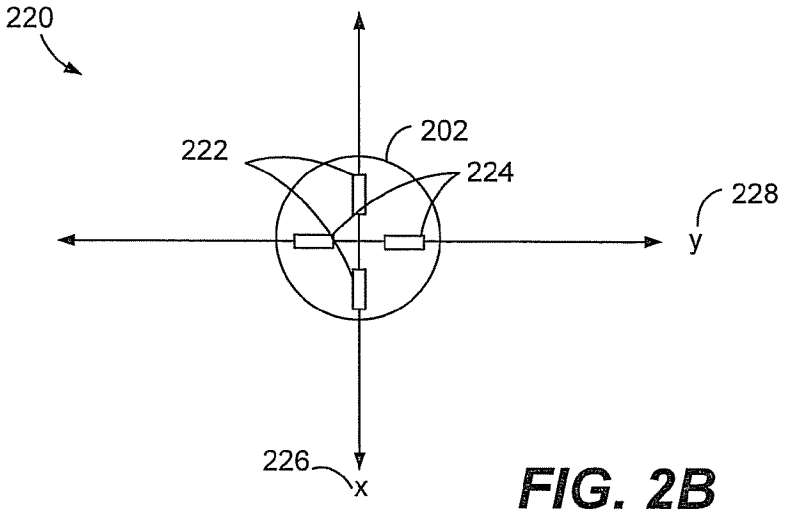
Figure 2C:
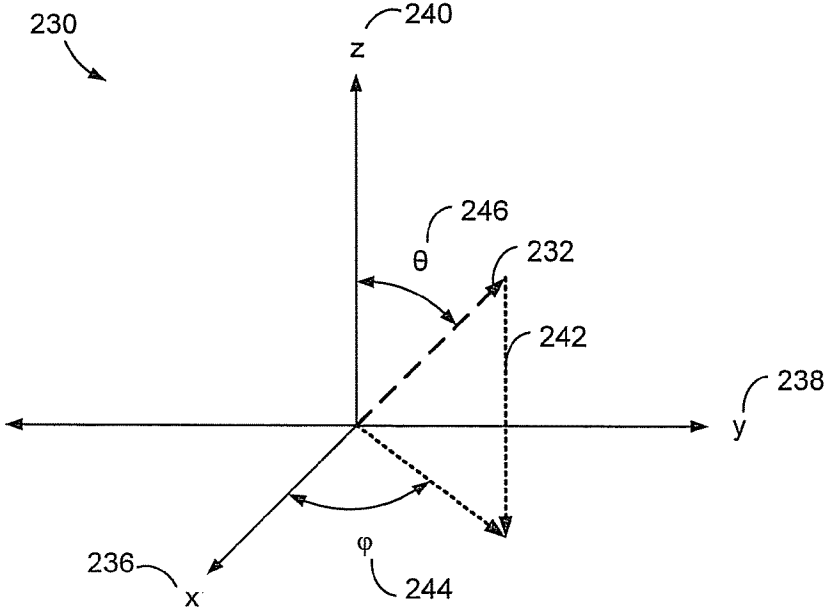

FIGS. 2A-2C illustrate the hemispherical coverage provide by a particular illustrative embodiment of the antenna of FIG. 1. FIG. 2A illustrates a three dimensional space 200 arrayed about an antenna 202 positioned at an origin of the three dimensional space 200. A hemispherical volume 204 depicts the hemispherical coverage of the antenna 202 in the three dimensional space including an x axis 206, a y axis 208, and a z axis 210.

FIG. 2B illustrates a planar view of the antenna 202 in an x-y plane 220 defined by an x axis 226 and a y axis 228. The antenna 202 includes a pair of perpendicularly disposed dipole antennas 222 and 224. A first dipole antenna 222 is aligned with the x axis 226 and a second dipole antenna 224 is aligned with the y axis 228 and, thus, is perpendicular to the first dipole antenna 222.

FIG. 2C illustrates a perspective view 230 of the coverage of the antenna. The perspective view 230 depicts a signal component 232 transmitted in a three-dimensional space defined by an x-axis 236, a y-axis 238, and a z-axis 240. The signal component 232 is transmitted, based on a projection 242 into an x-y plane at an angle $\phi$ 244 relative to the x axis 236. The signal component is transmitted at an angle $\theta$ 246 offset with respect to the z axis 240. As further described below, the phase of signal components is modulated in the x-y plane to modulate the angle $\phi$ 244 to provide a circularly-polarized signal throughout the x-y plane. As described below, the configuration of the pair of perpendicularly disposed dipole antennas provides coverage between the x-y plane and the z axis 240 to provide signal coverage for varying values of the angle $\theta$ 246.

Figure 3:
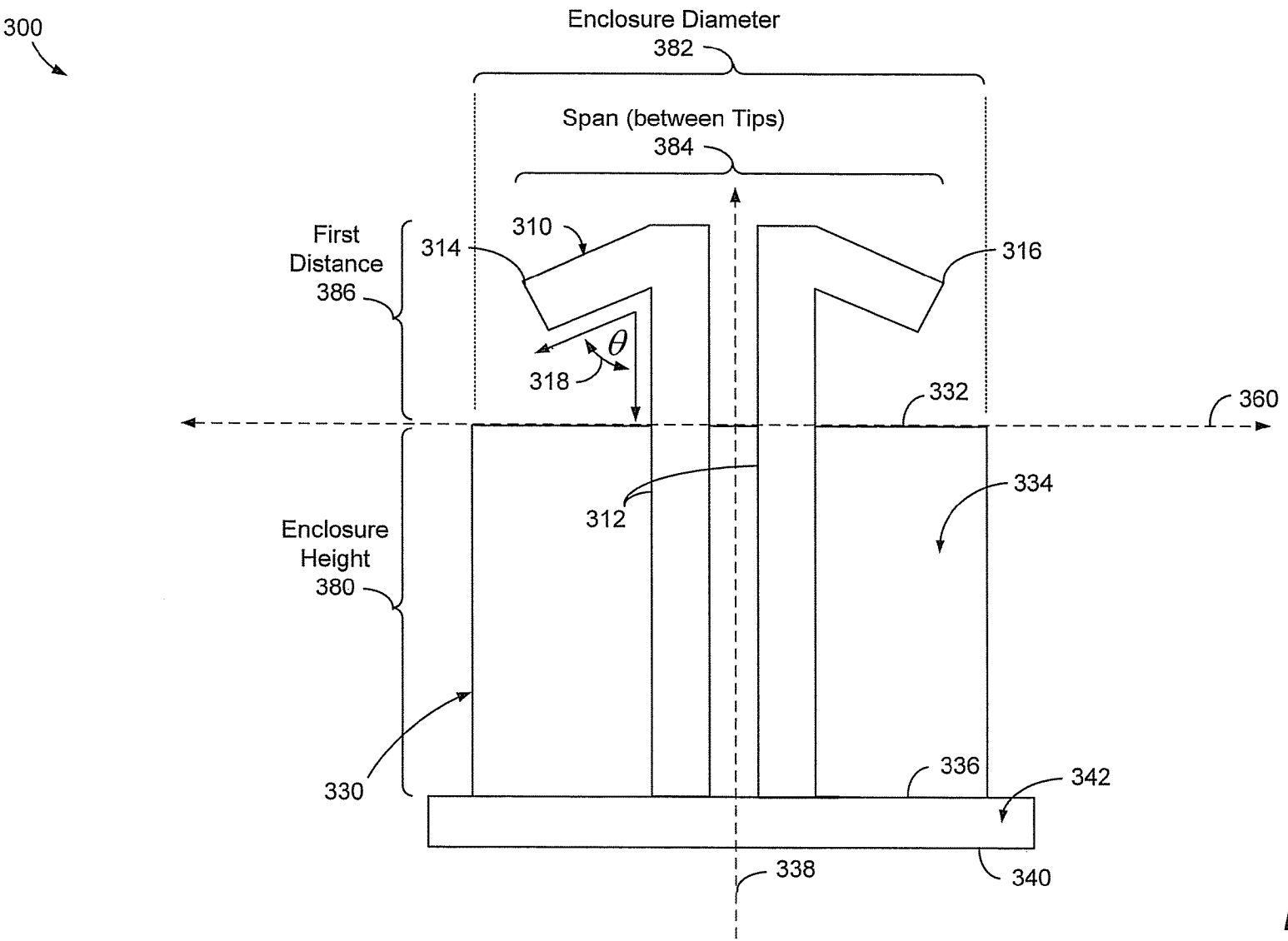
FIG. 3 is a cross-sectional view of an embodiment of an antenna system including a single dipole antenna extending through and beyond an open portion of a conductive enclosure.

FIG. 3 is a cross-sectional view of an embodiment of an antenna system 300 including a single dipole antenna 310 disposed within a conductive enclosure 330. Conductors 332 of the single dipole antenna 310 extend substantially along a central axis 338 from a closed portion 334 of the conductive enclosure 330 beyond an open portion 332 of the conductive enclosure 330 to a pair of tips 314,316 that extend along a first axis 360. As shown in FIG. 3, the conductive enclosure 330 is adjacent to a base 340 that may be used for mounting the antenna system 300 on a vehicle or another structure (not shown in FIG. 3).

The antenna system 300 using a single dipole antenna 310 as shown in the cross-sectional view of FIG. 3 may be used to provide-one-hundred-eighty degree coverage of a plane in which conductors 312 and tips 314, 316 of the single dipole antenna 310 lies. Alternatively, FIG. 3 may be regarded as a two-dimensional view of the antenna system 100 of FIG. 1 wherein the cross sectional view does not show the second dipole antenna that would be disposed perpendicularly to the single dipole antenna 310 of FIG. 3. According to a particular illustrative embodiment, both of the perpendicularly-disposed dipole antennas would have the same configuration and dimensions.

In one embodiment, the base 340 includes a compartment 342 in which circuitry, such as a hybrid phase coupler is used to control a phase of the signal applied to the antennas. The representative shape and dimensions of the single dipole antenna 310 of FIG. 3 would be the same in one embodiment of the antenna system 300 incorporating the single dipole antenna 310 as it would be for each antenna of a pair of perpendicularly-disposed dipole antennas 110 and 120 as shown in FIG. 1.

In order to provide a desired range of coverage, dimensions of the single dipole antenna 310 (or each antenna of a pair of perpendicularly-disposed dipole antennas) and the conductive enclosure 330 should be chosen to enable the direct signal from the single dipole antenna and the indirect signal reflected from within a cylindrical cavity 334 circumscribed by the conductive enclosure 330 to constructively interfere with each other. According to an embodiment of the antenna system 300, an acute angle $\theta$ 318 at which the tips 314, 316 extend from the conductors 312 is between forty degrees and seventy degrees (or an angle at which the tips 314, 316 are off-plane by fifty degrees to twenty degrees, respectively, with respect to a plane perpendicular to the conductors 312). Other dimensions of the antenna should be proportional to a wavelength at which signals will be transmitted. If signals will be transmitted at more than one wavelength, the dimensions may be chosen as proportional to on one of the intended wavelengths or the dimensions may be chosen to be proportional to an average of the intended wavelengths. Table (1) provides dimensions, relative to a wavelength $\lambda$, for the single dipole antenna 310 and the conductive enclosure 330. Specifically, Table (1) provides an enclosure height 380 (which, in the case of the antenna system 200 of FIG. 2 may be considered an enclosure depth) of the conductive enclosure 330, an enclosure diameter 382 of the conductive enclosure 330, a span 384 extending between a first tip 314 and an opposing, second tip 316 of the one or more dipole antennas, measured laterally along the first axis 360, and a height or a first distance 386 that one or more dipole antennas extend beyond an open portion 332 of the conductive enclosure 330. For purposes of example, Table (1) provides linear dimensions in inches for a wavelength λ of six inches that would correspond to a signal of 1.7 gigahertz.

TABLE (1)

| Dimension | Relative to Wavelength λ | Inches |
|---|---|---|
| Enclosure Height 380 | 0.42 λ | 2.52 inches |
| Enclosure Diameter 382 | 0.56 λ | 3.36 inches |
| Span between Tips 384 | 0.43 λ | 2.58 inches |
| First Distance 386 | 0.23 λ | 1.80 inches |

Computer modeling of a signal, such as a signal of wavelength λ, illustrates that by configuring one or more dipole antennas, such as the single dipole antenna 310 and the conductive enclosure 330 according to these dimensions, the combination of the direct signal and the indirect signal reflected by the conductive enclosure 330 provide hemispherical coverage as described with reference to FIGS. 2A-2C. Specifically, a particular illustrative embodiment provides one-hundred-eighty degree coverage about an axis extending parallel with the conductors 312 and, with appropriate phasing of a signal in a plane perpendicular to the axis, provides hemispherical, 2π steradian coverage in a three-dimensional space.

Figures 4A, 4B, 4C:
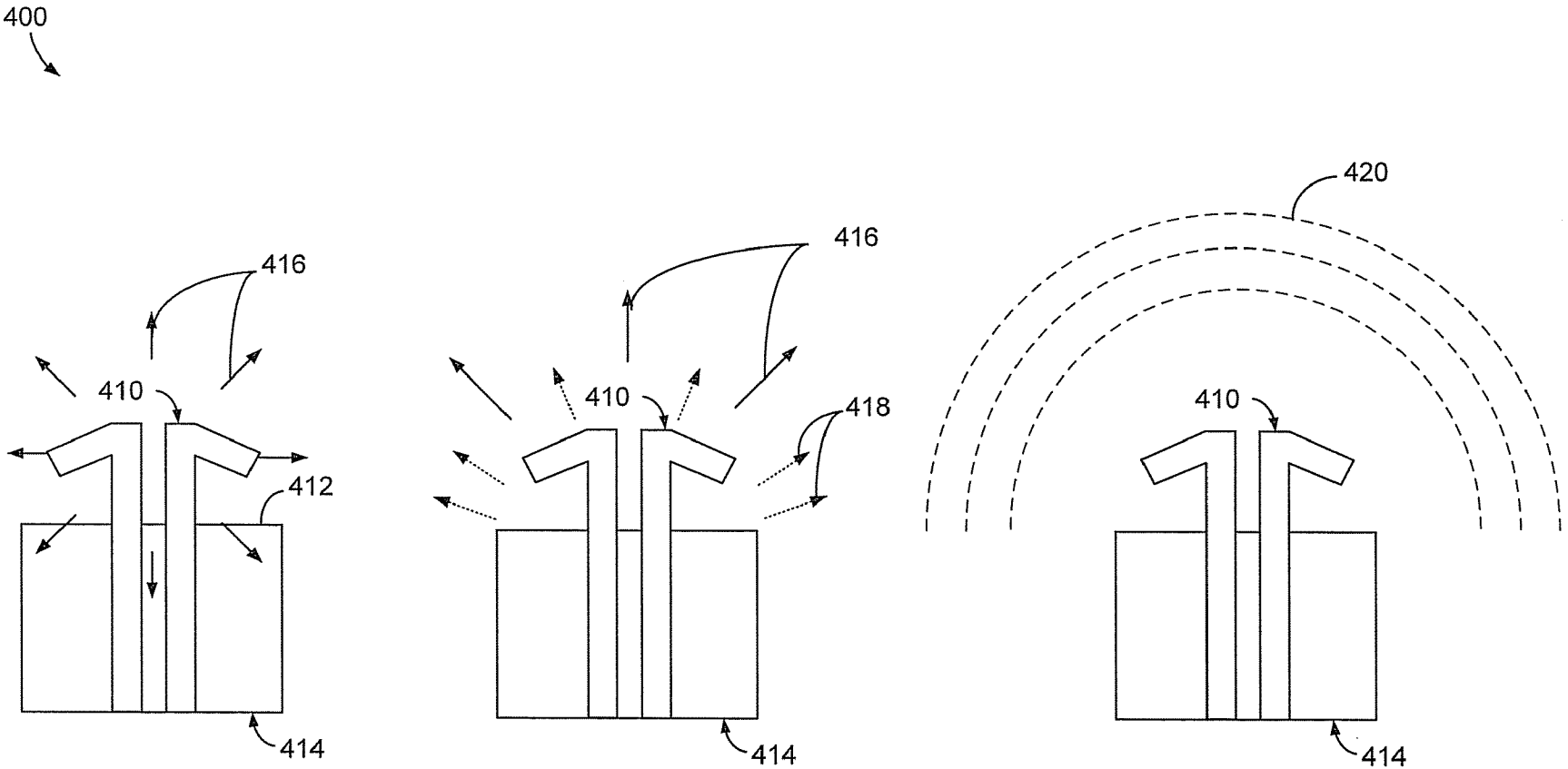
FIGS. 4A-4C are cross-sectional views of an embodiment of an antenna system from which components of a direct signal and components of an indirect signal combine to provide one-hundred-eighty degree signal coverage.

FIGS. 4A-4C symbolically illustrate how components of a direct signal and components of an indirect signal, resulting from a reflection by the conductive enclosure of components of the direct signal, from an antenna system 400 combine to provide one-hundred-eighty degree signal coverage. In FIG. 4A, a dipole antenna 410 extends beyond an open portion 412 of a conductive enclosure 414 as previously described. As a result of an applied signal (not shown in FIGS. 4A-4C), the dipole antenna 410 generates components of a direct signal 416. In FIG. 4B, as components of the direct signal 416 propagate away from the antenna system 400, components of an indirect signal 418 are generated as a result of the conductive enclosure 414 reflecting components of the direct signal 416. As depicted in FIG. 4C, the components of the direct signal 416 and the components of the indirect signal 418 combine to generate a signal 420 providing one-hundred-eighty degree coverage along the open portion 412 of the conductive enclosure 414. By modulating the phase of a pair of perpendicularly-disposed dipole antennas, the components of the direct signal 416 and the components of the indirect signal 418 combine to provide a circularly-polarized signal throughout the hemispherical, 2π steradian coverage area of the antenna system 400.

Figure 5B:
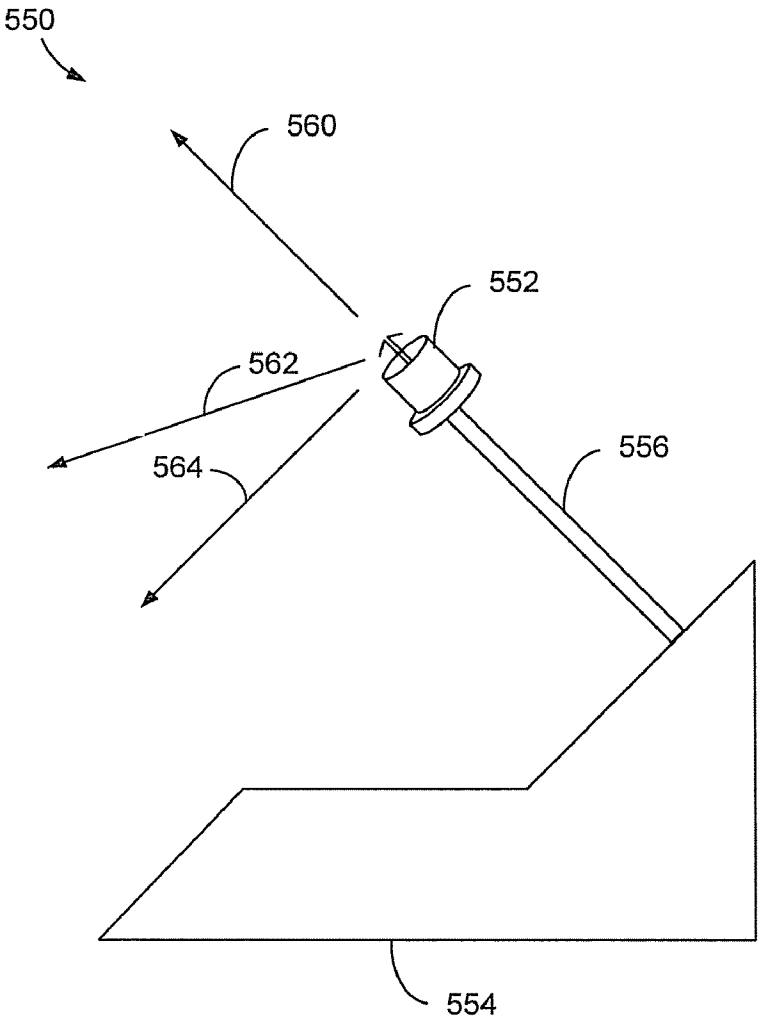
FIGS. 5A-5B are perspective views of an embodiment of the antenna of FIG. 1 mounted directly on a body and mounted on the body using a conductive mast.
Figure 5A:
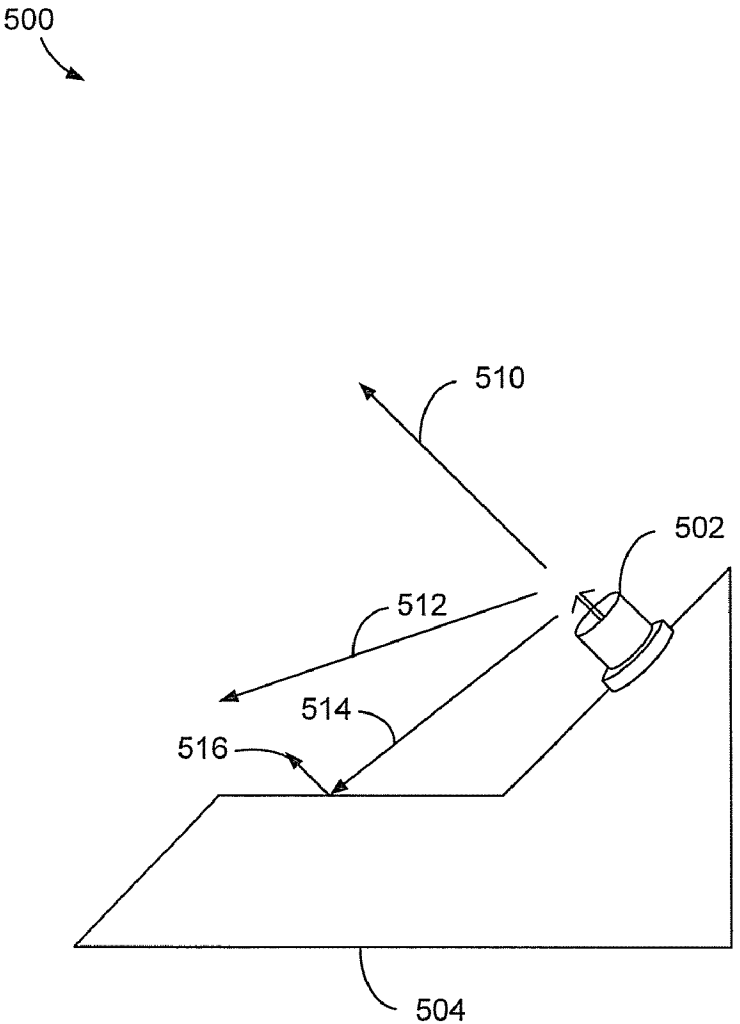

FIGS. 5A-5B depict a deployment of the antenna of FIGS. 1 and 4A-4C directly on a body 504 and displaced from a body 554 using a conductive mast 556. As shown in FIG. 5A, the antenna 502 transmits signal components 510, 512, and 514 as part of the hemispherical coverage provided by the antenna 302. However, the body 504 on which the antenna 502 is mounted may block the signal component 514, obstructing a portion of the hemispherical coverage provided by the antenna 502. Alternatively, the body 504 may completely or partially reflect the signal component 514, thereby generating a reflected 516 signal that may interfere with other signal components transmitted by the antenna 502.

FIG. 5B depicts an antenna 552 mounted on a mast 556 that displaces the antenna 552 from the body 554 on which it is mounted. By displacing the antenna 552 from the body, none of the signal components 560, 562, and 564 generated by the antenna 552 are blocked or reflected by the body 554, thereby reducing or preventing lapses in coverage and interference. In a particular illustrative embodiment, the mast 556 is comprised of a conductive material to prevent the absorption of charged particles and the risk of potentially harmful ESDs.

Figure 6A:
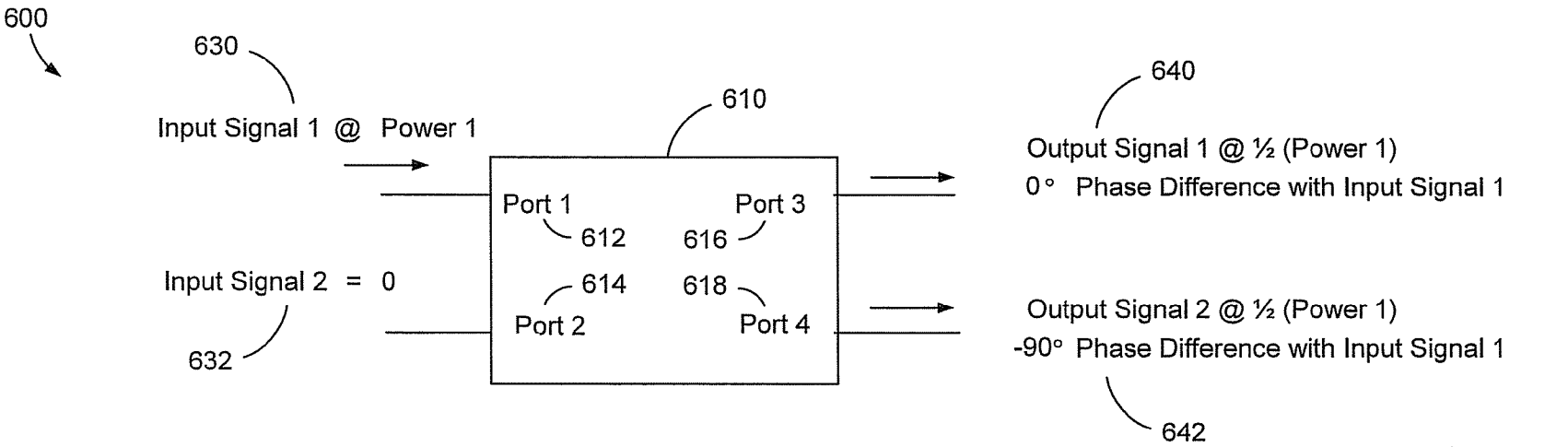
FIGS. 6A-6B are block diagrams of a hybrid coupler used to modulate a phase of input signals applies to input ports of the hybrid coupler.
Figure 6B:
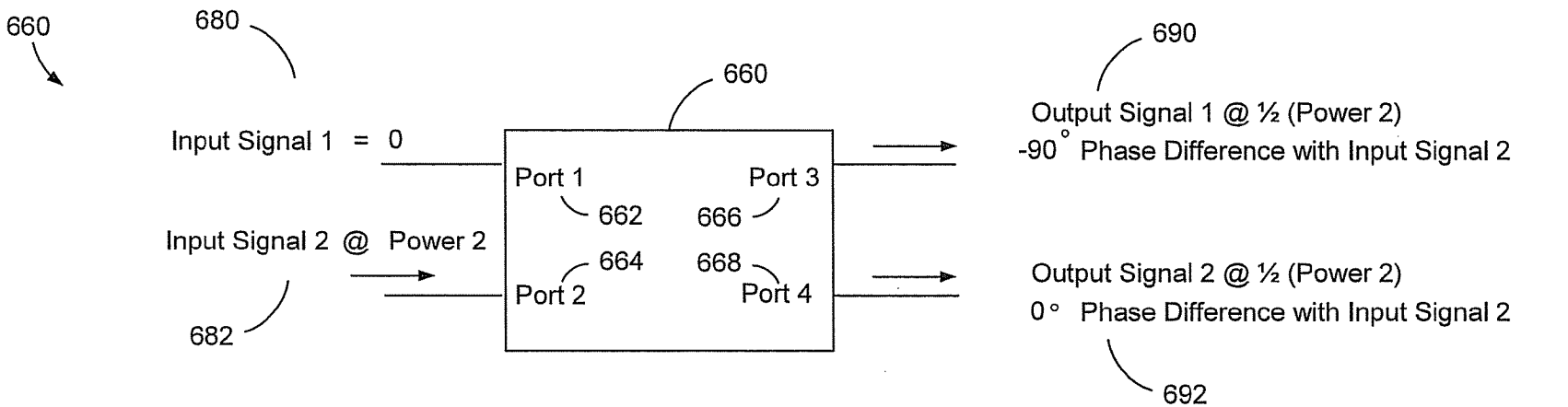

FIGS. 6A-6B each illustrate a hybrid coupler 600 and 650 used to control the phase of a signal applied to each antenna of a pair of perpendicularly-disposed dipole antennas to generate a circularly-polarized signal. The hybrid coupler 600 and 650 is a passive device including four ports 612-618. In a particular illustrative embodiment, the hybrid coupler is a three decibel (3 dB) hybrid coupler. General principles of operation of hybrid couplers are known by those skilled in the art. Using a hybrid coupler 600 and 650 enables broad bandwidth applications.

In the example of FIG. 6A, Port 1 612 and Port 2 614 are configured to receive input signals. Port 1 612 receives Input Signal 1 630 that has a signal power, Power 1, while Port 2 614 receives no input signal or a null input signal Input Signal 2 632. By operation of the hybrid coupler 600, Output Signal 1 640 generated at Port 3 616 has half the power of Input Signal 1 630 applied to Port 1 612 and, thus, Output Signal 1 642 has an output power of one-half of Power 1. Output Signal 1 640 has the same phase as Input Signal 1 630, thus, Output Signal 1 640 has no phase difference (or a zero degree phase difference) from Input Signal 1 630. Output Signal 2 642 generated by Port 4 618 also has half the power of Input Signal 1 630 applied to Port 1 612, providing an output power of one-half of Power 1 equal to that of Output Signal 1 640. However, in contrast to Output Signal 1 640, Output Signal 2 642 has a phase offset by negative ninety degrees (−90 degrees) with respect to the phase of Input Signal 1 630.

Output Signal 1 640 is applied to one of a pair of perpendicularly-disposed dipole antennas, and Output Signal 2 642 is applied to the other antenna of the pair of perpendicularly-disposed dipole antennas. Because the hybrid coupler 610 generates output signals Output Signal 1 640 and Output Signal 2 642 that are offset by ninety degrees to a pair of perpendicularly-disposed antennas—that are physically offset by ninety degrees—the hybrid coupler 610 enables hemispherical coverage with circular polarization signals around the pair of perpendicularly-disposed dipole antennas. Using the hybrid coupler 660, the signals generated by each of the pair of perpendicularly-disposed dipole antennas are of equal magnitude, but are ninety degrees out of phase from each other.

Moreover, particular illustrative embodiments of the present disclosure that employ a hybrid coupler enable a choice of right-hand circular polarization, left-hand circular polarization and dual circular polarization. In the example of FIG. 6B, Port 1 662 and Port 2 664 are configured to receive input signals. Port 2 664 receives Input Signal 2 682 that has a signal power, Power 2, while Port 1 662 receives no input signal or a null input signal Input Signal 1 680. By operation of the hybrid coupler 660, Output Signal 2 692 generated at Port 4 668 has half the power of Input Signal 2 682 applied to Port 2 664 and, thus, Output Signal 2 692 has an output power of one-half of Power 1. Output Signal 2 692 has the same phase as Input Signal 2 682, thus, Output Signal 2 692 has no phase difference (or a zero degree phase difference) from Input Signal 2 682. Output Signal 1 690 generated by Port 4 666 also has half the power of Input Signal 2 682 applied to Port 2 664, providing an output power of one-half of Power 2 equal to that of Output Signal 2 692. However, in contrast to Output Signal 2 692, Output Signal 1 690 has a phase offset by negative ninety degrees (−90 degrees) with respect to the phase of Input Signal 2 682.

Output Signal 2 692 is applied to one of a pair of perpendicularly-disposed dipole antennas, and Output Signal 1 690 is applied to the other antenna of the pair of perpendicularly-disposed dipole antennas. Because the hybrid coupler 660 generates output signals Output Signal 1 692 and Output Signal 1 690 that are offset by ninety degrees to a pair of perpendicularly-disposed antennas—that are physically offset by ninety degrees—the hybrid coupler 660 enables circular polarization of the signal using the pair of perpendicularly-disposed dipole antennas.

However, in contrast to the example of FIG. 6A, which results in right-hand circular polarization, applying Input Signal 2 682 to Port 2 664 and applying a null signal or no signal as Input Signal 1 to Port 1 662, operation the hybrid coupler 660 results in left-hand circular polarization of Input Signal 2 682. Furthermore, if different, non-nulls signals were simultaneously applied to Port 1 662 and Port 2 664 of the hybrid coupler 660, the result would be simultaneous, dual circular polarization of the signals applies to Port 1 662 and Port 2 664.

Figure 7:
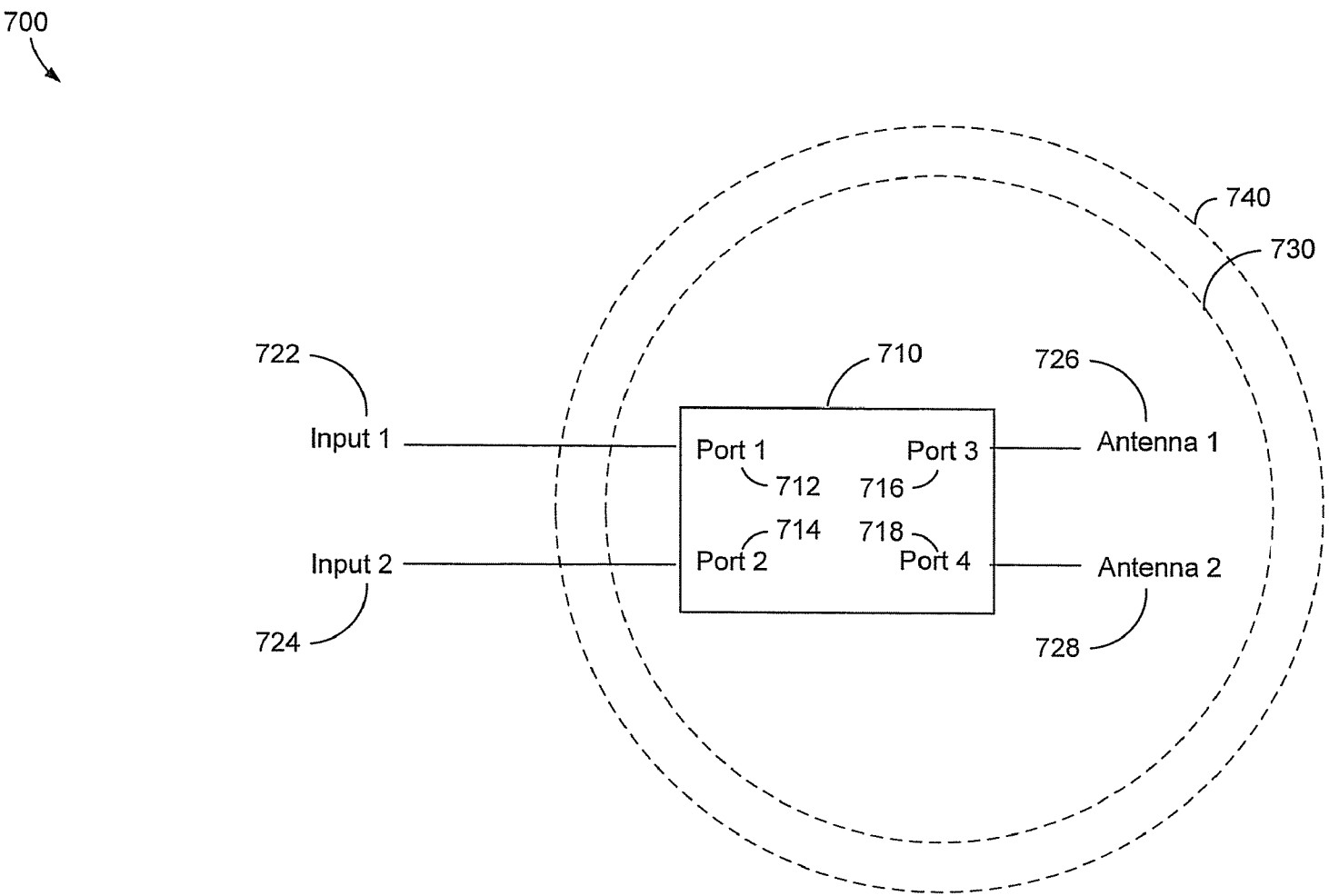
FIG. 7 is a block diagram of the hybrid coupler of FIGS. 6A-6B disposed in a compartment of the antenna of FIG. 1.

FIG. 7 illustrates a block diagram of an antenna system 700 including a hybrid coupler 710, such as the hybrid coupler 610 or 660 of FIGS. 6A-6B, disposed in a compartment 740 at a closed end of the conductive enclosure 730. The hybrid coupler 710 includes two input ports, Port 1 712 and Port 2 714, to which Input 1 722 and Input 2 724, respectively, are provided outside the compartment 740 to enable communications access to the antenna system 700. The hybrid coupler 710 includes two output ports, Port 3 716 and Port 4 718, that are coupled to each of a pair of perpendicularly-disposed dipole antennas Antenna 1 726 and Antenna 2 728, which may include dipole antennas configured as described with reference to FIG. 3. Input 1 722 and Input 2 724 to the hybrid coupler 710 enable one or more signals to be transmitted using the antenna system 700 using right-hand circular polarization, left-hand circular polarization, or dual circular polarization, as described with reference to FIG. 7.

Figure 8:
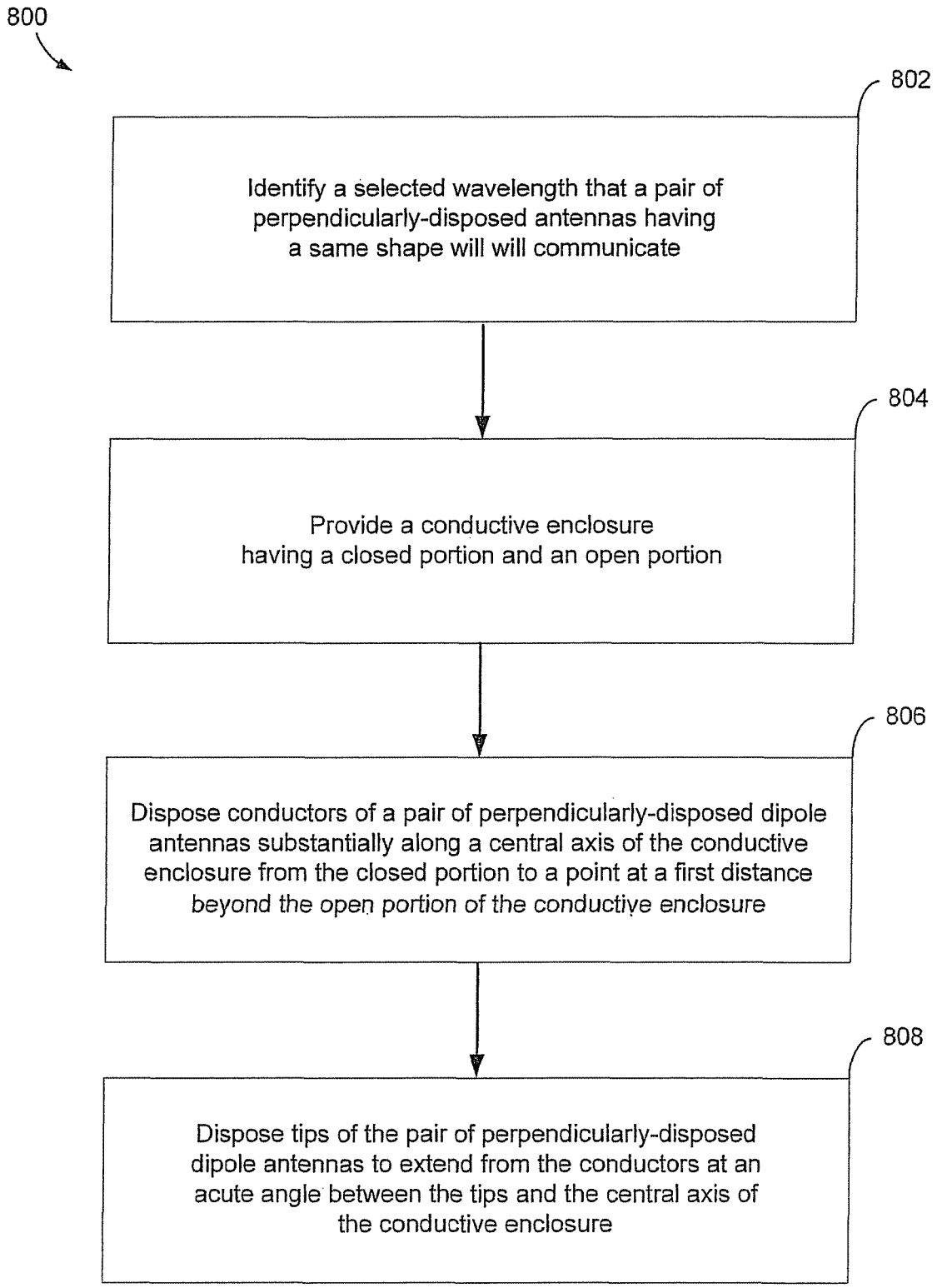
FIG. 8 is a flow chart of an embodiment of forming an antenna system of the present disclosure.

FIG. 8 is a flow chart 800 of an illustrative embodiment of a method of forming an antenna system of the present disclosure. A selected wavelength to be communicated by a pair of perpendicularly-disposed dipole antennas is identified, at 802. A conductive enclosure having an open portion and a closed portion is provided, at 804. Conductors of a pair of perpendicularly-disposed dipole antennas are disposed substantially along a central axis of a cylindrical conductive enclosure, with the conductors extending from the closed portion to a first distance beyond the open portion of the conductive enclosure, at 806. Tips of the pair of perpendicularly-disposed dipole antennas extend from the conductors at an acute angle between the tips and the central axis of the conductive enclosure, at 808.

In forming an antenna as described with reference to FIG. 8, identifying a selected wavelength of operation determines the dimensions of the perpendicularly-disposed dipole antennas and the conductive enclosure. As previously described with reference to FIG. 3, desired coverage is achieved by forming and positioning the conductive enclosure and the dipole antennas in relative dimensions proportional to the selected wavelength. Once formed, the pair of perpendicularly-disposed dipole antennas extending beyond the open portion of the conductive enclosure provides one-hundred-eighty degree coverage in a two-dimensional space or hemispherical, $2\pi$ steradian coverage of a three-dimensional space. Direct components of a signal transmitted by the pair of perpendicularly-disposed dipole antennas and indirect components of the signal reflected by the conductive enclosure from the direct components of the signal provide desired wide area coverage.

The illustrations of the embodiments described herein are intended to provide a general understanding of the structure of the various embodiments. The illustrations are not intended to serve as a complete description of all of the elements and features of apparatuses and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the illustrations or one or more method steps may be omitted. Accordingly, the disclosure and the figures are to be regarded as illustrative rather than restrictive.

Moreover, although specific embodiments have been illustrated and described herein, it should be appreciated that any subsequent arrangement designed to achieve the same or similar results may be substituted for the specific embodiments shown. This disclosure is intended to cover any and all subsequent adaptations or variations of various embodiments, as defined by the following claims. Combinations of the above embodiments, and other embodiments not specifically described herein, will be apparent to those of skill in the art upon reviewing the description.

In the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. A system, comprising:

a conductive enclosure, wherein the conductive enclosure includes a conductive cylinder having an open portion and a closed portion;

a pair of perpendicularly-disposed dipole antennas, wherein each antenna of the pair of perpendicularly-disposed dipole antennas includes a pair of conductors extending through the closed portion of the conductive enclosure a first distance beyond the open portion of the conductive enclosure along a central axis of the conductive enclosure to a pair of tips disposed outside of the open portion of the conductive enclosure, and wherein each pair of tips extends from each pair of conductors at an acute angle of between forty and seventy degrees between each of the tips and the central axis of the conductive enclosure; and a hybrid coupler, the hybrid coupler having a pair of output terminals coupled to each pair of conductors of each antenna of the pair of perpendicularly-disposed dipole antennas, wherein the hybrid coupler is configured to apply signals of equal magnitude to the pair of perpendicularly-disposed dipole antennas that differ in phase by ninety degrees, wherein dimensions of the conductive cylinder and the pair of dipole antennas are proportional to a selected frequency, the dimensions including:

an enclosure height between the closed portion of the conductive enclosure and the open portion of the conductive enclosure along the central axis of approximately 2.52 inches;

an enclosure diameter of the open portion of the conductive enclosure of approximately 3.36 inches;

a span extending between the pair of tips of each antenna of the pair of perpendicularly-disposed dipole antenna of approximately 2.58 inches; and the first distance that each antenna of the pair of conductors extends beyond the open portion of the conductive enclosure along the central axis of approximately 1.80 inches.

2. The system of claim 1, wherein the first distance and the acute angle are configured to cause a direct signal generated by the pair of perpendicularly- disposed antennas and an indirect signal generated by reflection by the conductive enclosure of the direct signal to provide generally hemispherical coverage of a three-dimensional space.

3. The system of claim 2, wherein the pair of perpendicularly-disposed dipole antennas is configured to operate in a frequency range of approximately 1.7 gigahertz to 2.3 gigahertz.

4. The system of claim 1, wherein the conductive enclosure is comprised of at least one of aluminum, copper, brass, gold, silver, and graphite.

5. The system of claim 1, further comprising a conductive mast supporting the conductive enclosure at a distance from a body.

6. The system of claim 1, wherein the hybrid coupler is disposed in a compartment that is coupled to the closed portion of the conductive enclosure.

7. The system of claim 1, wherein the hybrid coupler includes an input terminal and an isolated terminal, wherein a first signal having a first frequency is applied to the input terminal and a second signal having a second frequency is applied to the isolated terminal, resulting in a right-hand circular polarization of the first signal and a left-hand circular polarization of the second signal.

8. A system, comprising:

a conductive enclosure, wherein the conductive enclosure includes an open portion and a closed portion; and a first dipole antenna having tips disposed outside of the open portion of the conductive enclosure, wherein a positioning of the tips and dimensions of the conductive enclosure are configured in proportion to a selected wavelength to transmit a direct signal generated by the first dipole antenna and an indirect signal reflected by the conductive enclosure to provide a $2\pi$ steradian coverage area, and wherein the first dipole antenna includes:

a pair of conductors extending through the closed portion of the conductive enclosure to a first distance beyond the open portion of the conductive enclosure substantially along a central axis of the conductive enclosure; and each of the tips extends from one of the pair of conductors at an acute angle between forty and seventy degrees between the tip and the central axis of the conductive enclosure, and wherein a span extending between the tips is approximately 0.43 of the selected wavelength and the first distance is approximately 0.23 of the selected wavelength, wherein an enclosure height between the closed portion of the conductive enclosure and the open portion of the conductive enclosure along a central axis of the conductive enclosure is approximately 0.42 of the selected wavelength and an enclosure diameter of the open portion of the conductive enclosure is approximately 0.56 of the selected wavelength.

9. The system of claim 8, further comprising a second dipole antenna, wherein:

the second dipole antenna includes a second pair of conductors extending through the closed portion of the conductive enclosure to the first distance beyond the open portion of the conductive enclosure substantially along the central axis of the conductive enclosure;

the second pair of conductors ends in a second pair of tips extending from the second pair of conductors at an acute angle between each of the second pair of tips and the central axis of the conductive enclosure; and the second dipole antenna is disposed perpendicularly to the first dipole antenna about the central axis of the conductive enclosure.

10. The system of claim 9, wherein the first dipole antenna and the second dipole antenna are coupled to a hybrid coupler configured to control a circular polarization of one or more signals applied to the first dipole antenna and to the second dipole antenna.

11. A method, comprising:

identifying a selected wavelength at which a pair of perpendicularly-disposed dipole antennas will operate, wherein each antenna of the pair of perpendicularly-disposed dipole antennas has a same shape and includes conductors ending in tips;

providing a conductive enclosure having a closed portion and an open portion, wherein the conductive enclosure has an enclosure height between the closed portion of the conductive enclosure and the open portion of the conductive enclosure along a central axis of the conductive enclosure, wherein the enclosure height is approximately 0.42 of the selected wavelength, and wherein an enclosure diameter of the open portion of the conductive enclosure is approximately 0.56 of the selected wavelength;

disposing the conductors of the pair of perpendicularly disposed dipole antennas to extend substantially along the central axis of the conductive enclosure from the closed portion of the conductive enclosure to a first distance beyond the open portion of the conductive enclosure; and disposing the tips of the pair of perpendicularly disposed dipole antennas to extend from the conductors at an acute angle of less than seventy degrees between the tips and the central axis of the conductive enclosure, wherein a span extending between a first tip and an opposing tip of each antenna of the pair of perpendicularly-disposed dipole antennas is approximately 0.43 of the selected wavelength, and wherein the first distance is approximately 0.23 of the selected wavelength.

12. The method of claim 11, further comprising coupling the pair of perpendicularly disposed dipole antennas to a directional coupler configured to control a circular polarization of one or more signals applied to the pair of perpendicularly disposed dipole antennas to generate a signal having at least one of right-hand circular polarization and left-hand circular polarization.

* * * * *